United States Patent [19]

McCullough

[11] Patent Number: 4,706,056

[45] Date of Patent: Nov. 10, 1987

[54] ELECTRICAL RELAY APPARATUS

[75] Inventor: Harold E. McCullough, Blacklick, Ohio

[73] Assignee: American Telephone and Telegraph Company, AT&T Bell Laboratories, Murray Hill, N.J.

[21] Appl. No.: 906,023

[22] Filed: Sep. 11, 1986

[51] Int. Cl.[4] ..... H01H 51/08; H01H 7/08; H01H 3/00

[52] U.S. Cl. ..... 335/192; 335/128; 335/274

[58] Field of Search ..... 335/192, 128, 274, 275, 335/276

[56] References Cited

U.S. PATENT DOCUMENTS 3,239,727 3/1966 Zupa ..... 335/274

4,322,700 3/1982 Everhart et al. ..... 335/128

4,439,750 3/1984 Fujii ..... 335/274

*Primary Examiner*—Harold Broome

*Attorney, Agent, or Firm*—Dwight A. Marshall

[57] ABSTRACT

A miniaturized electromechanical relay (1) with an armature assembly (14) and a contact assembly (13) mounting contacts thereon and having a magnetic member assembly (12) for activating the armature assembly to operate the contact assembly to engage and disengage the contacts. A spring member (16) for mounting the armature assembly on the magnetic member assembly is configured for generating a torsional moment in combination with a cantilever force on the armature assembly to maintain the armature assembly in a rotational relationship with the magnetic member assembly to control operation of the contacts in response to magnetic flux generated by the magnetic member assembly.

6 Claims, 5 Drawing Figures

FIG. 3
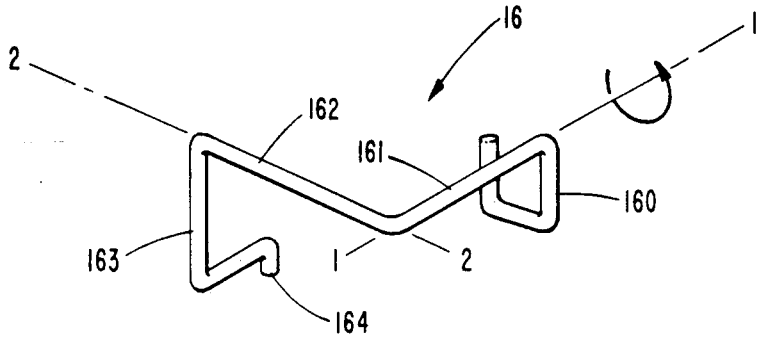
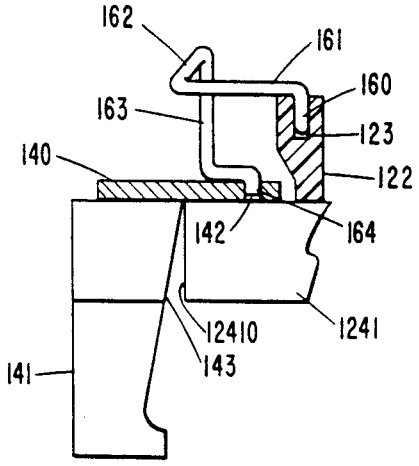
FIG. 4
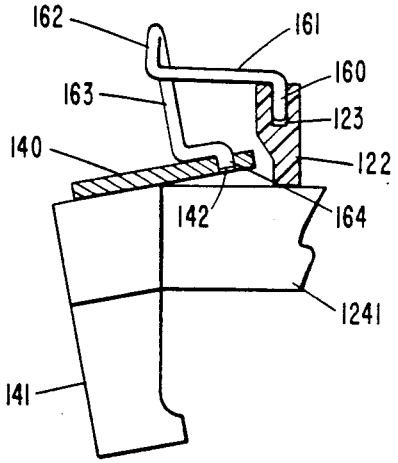
FIG. 5

ELECTRICAL RELAY APPARATUS

BACKGROUND OF THE INVENTION

1. Field of the Invention

This invention relates to electromechanical relays. In particular, it relates to the construction of miniature electromechanical relays intended for use on circuit boards.

2. Description of the Prior Art

Electromechanical relays have found wide and varied applications in the Telecommunications and Electronics Industry. Although solid state devices have recently replaced relays in many telecommunications and electronic systems, electromechanical relays still offer many advantages in terms of cost and reliability in electrical circuit applications.

Electromechanical relays generally comprise an electromagnet, armature and contact assemblies wherein the energization of the electromagnet actuates the armature assembly to control the operation of the contact assembly thereby engaging and disengaging contacts to control external electrical circuitry coupled with the relay. In modern technology, miniaturization of components have resulted in large numbers of components being mounted on circuit boards. Since space on circuit boards is at a premium, electromechanical relays have been reduced in size so as to require only a small amount of mounting space on a circuit board. As the size of components have decreased and the number of electrical circuits appearing on a circuit board increased, the electrical current requirements for circuit boards have also been decreased thereby requiring the development of low current electromechanical relays.

A problem arises in the development of miniature and low current electromechanical relays in that the operating sensitivity of an electromechanical relay is affected by the reduction in size of the relay electromagnet apparatus and the amount of electrical current required to activate the relay armature. For example, relay armatures in previous miniature electromechanical relays require an elaborate design of spring members to hold the armatures in position with respect to the electromagnet. Such elaborate spring members require a large relay structure and an increase of electrical current to activate the armature to overcome the spring tension force thereby lowering the operating sensitivity of the relay.

Accordingly, a need exists for a miniature low current electromechanical relay having a high degree of operating sensitivity. A need also exists for an electromechanical relay requiring a small mounting space on a circuit board and a small amount of electrical current to activate an armature to engage and disengage contacts for controlling external electrical circuitry.

SUMMARY OF THE INVENTION

The foregoing problems are solved and a technical advantage is achieved by an electromechanical relay having an armature assembly and a contact assembly in combination with a magnetic member assembly. The electromechanical relay structure has a spring member for mounting the armature assembly on the magnetic member assembly with the spring member configured for generating a torsional moment in combination with a cantilever force on the armature assembly to maintain the armature assembly in a rotational relationship with the magnetic member assembly. Magnetic flux generated by the magnetic member assembly activates the spring mounted armature assembly to control the contact assembly to operate and release contacts mounted on the contact assembly.

In accordance with the invention, an electromechanical relay having a contact assembly activated by an armature assembly in combination with a magnetic member assembly comprises a spring member for mounting the armature assembly on the magnetic member assembly. The spring member has a generally L-shaped member vertically positioned in the center of an upper surface of the armature assembly with one end thereof formed for attachment to the armature assembly to hold the armature assembly with respect to the magnetic member assembly.

Also in accordance with the invention, an electromechanical relay having a contact assembly activated by an armature assembly in combination with a magnetic member assembly comprises a spring member for mounting the armature assembly on the magnetic member assembly. The spring member has a cantilever member formed at a generally right angle from an end of an L-shaped member vertically positioned on an upper surface of the armature assembly and attached thereto for generating a force on the armature assembly normally maintaining the armature assembly rotated in a spaced apart relationship with respect to the magnetic member assembly.

In further accordance with the invention, an electromechanical relay having a contact assembly activated by an armature assembly in combination with a magnetic member assembly comprises a spring member for mounting the armature assembly on the magnetic member assembly. The spring member has an axial torsion member formed at a generally right angle from an end of a cantilever member having the other end thereof connected to an L-shaped member attached to the armature assembly for use in mounting the spring member and attached armature assembly with the magnetic member assembly. The torsion member generates a rotational moment upon activation of the armature assembly by magnetic flux generated by the magnetic member assembly to return the armature assembly to a spaced apart relationship upon removal of the generated flux thereby enabling the contact assembly to control operation of contacts located on the contact assembly.

BRIEF DESCRIPTION OF THE DRAWING

The foregoing as well as other objects, features and advantages of the invention will be more apparent from a description of the drawing in which;

FIG. 3 is a perspective view of a spring member for use with the electromechanical relay set forth in FIGS. 1 and 2; and FIGS. 4 and 5 illustrate operative positions of the spring member set forth in FIGS. 1, 2 and 3.

DESCRIPTION OF THE INVENTION

Figure 1:
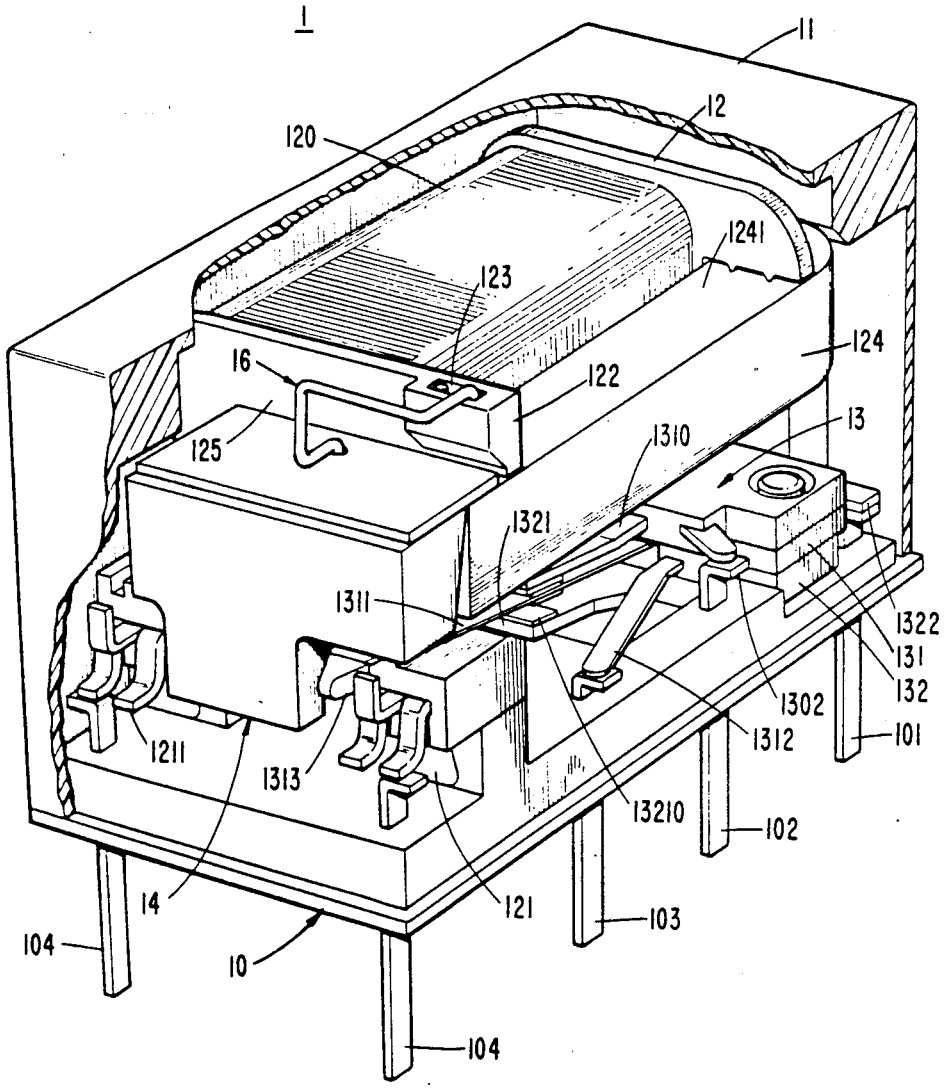
FIG. 1 depicts in perspective view one illustrative electromechanical relay according to the invention with an enclosing cover broken away to disclose various assembled operative elements embodying the principles of the instant invention.

Referring to the drawing and more specifically to FIG. 1 of the drawing, the electromechanical relay 1 set forth therein is a miniature relay intended for use in mounting on a circuit board and to function in operating circuitry both external to and located on the circuit board. Typically, electromechanical relay 1 has a base member 10 on which is mounted a contact assembly 13 having a number of contacts located thereon such as contact 13210. In addition, electromechanical relay 1 has an armature assembly 14 used to operate contact assembly 13 and an electromagnetic member assembly 12 that is enabled by an electrical current applied to relay 1 to activate armature assembly 14.

The electromagnetic member assembly 12 of the present invention includes a magnetic core member 124 having a bobbin 125 positioned thereon on which is wound a coil 120 connected to terminals 104 located in base member 10. In operation, an electrical current applied to coil terminals 104 generates a magnetic field that magnetizes magnetic core member 124 to activate armature assembly 14. The activation of armature assembly 14 operates contact assembly 13 to engage and disengage contacts such as contacts 13210 that are connected with terminals 101, 102, 103 to control electrical circuitry connected with electromechanical relay 1. A cover 11 is usually placed over the electromagnetic member and contact assemblies 12, 13 and bonded to base member 10 to protect electromechanical relay 1.

Figure 2:
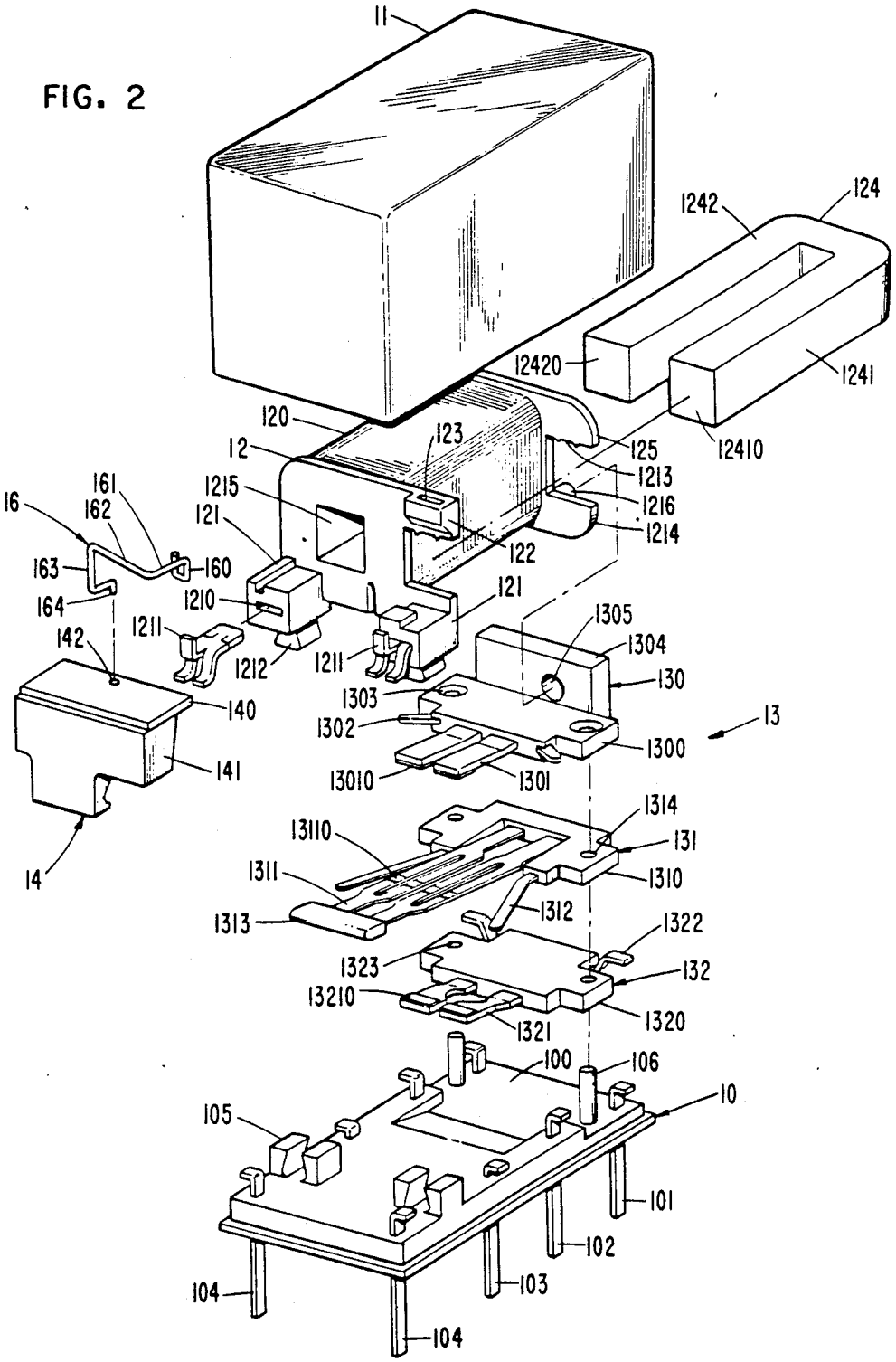
FIG. 2 is an exploded view of the operative elements of the electromechanical relay set forth in FIG. 1.

Referring now to FIG. 2 of the drawing, base member 10 may be formed of any one of a number of well-known insulating materials to have a generally rectangular configuration in which are mounted a number of terminals 101, 102, 103, 104. Base member 10 also has a pair of mounting embossments 105 and posts 106 used to mount and support electromagnetic member and contact assemblies 12, 13, respectively, on base member 10.

Contact assembly 13 may comprise a pair of contact spring assemblies or a pileup of contact spring assemblies 130, 131, 132. A contact spring assembly such as contact spring assembly 132 has a support member 1320 formed of electrical insulating material in which is mounted a single or pair of contact springs 1321. Each contact spring 1321 has a contact 13210 that may be formed of a precious metal positioned on one end of contact spring 1321. Contact springs 1321 extend through support member 1320 with the end opposite contact 13210 formed in a contact terminal 1322. In assembly, support member 1320 is positioned on base member 10 with mounting posts 106 extended through support member mounting holes 1323 and each contact terminal 1322 welded or affixed to a corresponding lower contact pair terminal 101.

Similarly, middle contact spring assembly 131 comprises a support member 1310 mounting a single or pair of flexible bifurcated contact springs 1311 each having a pair of contacts 13110 positioned in the center of the bifurcated sections of contact springs 1311. A contact spring operate member 1313 is affixed to the ends of contact springs 1311 and each contact spring extends through support member 1310 and is formed into contact terminal 1312. In assembly, middle contact spring assembly 131 is mounted on base member 10 on top of contact spring assembly 132 with mounting posts 106 extending through holes 1314 and contact terminals 1312 each welded or affixed to a corresponding middle contact pair terminal 103. Upper contact spring assembly 130 comprises a single or a pair of contact springs 1301 mounted in a support member 1300 having a rear vertical section 1304 with a mounting hole 1305 formed therein. Each contact spring 1301 has a contact 13010 located at one end and extends through support member 1300 into contact terminal 1302. Spring contact assembly 13 pileup is completed by mounting support member 1300 onto base member mounting posts 106 with each contact terminal 1302 welded or affixed to a corresponding upper contact pair terminal 102.

Bobbin 125 is a generally cylindrical configured member formed of electrical insulating material to have a central aperture 1215 and a pair of flanges 1214 at each end thereof with each flange having a section 1213 cut therein such that the legs 1241, 1242 of magnetic core member 124, may be inserted into flange sections 1213 and into central aperture 1215. One flange 1214 has a pair of bobbin coil terminal assemblies 121 formed thereon with each bobbin coil terminal assembly 121 having a cavity 1210 for receiving a coil terminal 1211. The other flange 1214 has a mounting post 1216 extending outward therefrom. One or more coils 120 may be wound on bobbin 125 to encircle a leg 1242 of magnetic core 124 with each of the coil wires connected to a coil terminal 1211. A bottom portion 1212 of each bobbin coil terminal assembly 121 is inserted into base member embossments 105 and bobbin mounting post 1216 is inserted into bobbin mounting hole 1305 of upper contact spring assembly 130 to mount bobbin 125 and magnetic core member 124 on base member 10. Each coil terminal 1211 is either welded or affixed to a corresponding base member coil terminal 104.

Armature assembly 14 is positioned in electromechanical relay 1 with respect to pole areas 12410, 12420 of magnetic core member 124 and contact spring operate section 1313 so that contacts 13110 of middle contact spring assembly 131 remain in normal engagement with contacts 13010 of upper contact spring assembly 130. An electrical conducting path is thereby established between base terminals 102 and 103 through engaged contacts 13010 and 13110 of upper and middle contact spring assemblies 130 and 131.

Magnetic core member 124 may be a generally U-shaped member having a rectangular shaped cross-sectional area throughout and a pair of legs 1241, 1242 each having a pole area 12410, 12420, respectively, located at the end thereof.

In assembly, magnetic core member 124 is positioned within bobbin 125 to form a magnetic member assembly 12 wherein legs 1242, 1241 are each positioned in central aperture 1215 and flange sections 1213, respectively, such that the pole areas 12420, 12410 at each end extend outward from one of the bobbin flanges 1214. A boss 122 is formed at one side of a bobbin flange 1214 adjacent pole areas 12410, 12420 and has a slot 123 for attaching the armature assembly 14 via spring member 16 to magnetic member assembly 12.

Spring member 16 functions to mount armature assembly 14 comprising armature 141 and flange member 140 on bobbin 125 in a juxtaposed relationship with respect to magnetic member assembly 12. In one embodiment of the invention, an electrical current applied through coil terminals 104 results in magnetic core member 124 generating magnetic flux at pole areas 12410 and 12420. The generated magnetic flux activates the relay armature assembly 14 by rotating armature 141, FIGS. 4 and 5, about an axis located parallel to upper edges of the magnetic member poles areas 12410, 12420 such that armature surface 143 is positioned adjacent pole areas 12410, 12420. Activation of the armature assembly 14 moves contact spring operate section 1313, FIG. 2, inward to bow middle contact spring assembly 1311 and disengage contacts 13110 from contacts 13010 of upper contact springs 1301 thereby opening the electrical path previously existing between middle and upper contact terminals 103 and 102. In addition, the bowing of middle contact spring assembly 1311 functions to engage contacts 13110 with contacts 13210 of lower contact assembly 132 and establish an electrical path through lower and middle contact terminals 101 and 103. Removal of the electrical current from coil winding 120 removes the magnetic flux from magnetic core member pole areas 12410, 12420 and allows spring member 16, FIG. 4, to return armature assembly 14 to a spaced apart relationship with respect to the magnetic core member pole areas 12410, 12420. Return of armature assembly 14 to the spaced apart position moves contact spring operate section 1313, FIG. 2, to disengage contacts 13110 from contacts 13210 and re-engage contacts 13110 with contacts 13010.

Spring member 16, mounting armature assembly 14 on magnetic member assembly 12, is configured for generating a torsional moment in combination with a cantilever force on armature assembly 14 for maintaining armature assembly 14 in a rotational relationship with respect to the magnetic member assembly 12 to operate and release contacts of contact assembly 13. More specifically, spring member 16, FIG. 3, has a generally L-shaped member 163 which is vertically positioned on and in the center, FIG. 2, of an upper surface of armature flange 140. One end 164 of L-shaped member 163 is formed downward with respect to L-shaped member 163 for insertion into hole 142 of armature flange 140. Spring member 16 may thus be attached to armature flange 140 by sizing hole 142 to receive end 164 in a slip fit, or end 164 may be welded to armature flange 140 such that spring member 16 holds armature assembly 14.

L-shaped member 163, FIG. 3, has an upper end opposite attachment end 164 formed at a generally right angle into one end of a cantilever member 162 provided for generating a force on armature flange 140, FIG. 4, normally maintaining armature 14 rotated in a spaced apart relationship with respect to magnetic pole areas 12410, 12420. The opposite end of cantilever member 162, FIG. 3, is pivotally formed into an axial torsion member 161 having the opposite end 160 configured in a generally U-shaped structure.

In assembly, the extended part of armature flange 140, FIG. 4, is positioned on the upper edges of the ends of magnetic core member 124 thereby enabling rotational movement of armature 14 about an axis parallel to upper edges of magnetic core member pole areas 12410, 12420. The U-shaped end 160 of spring member 16 is inserted into slot 123 of bobbin boss 122 to mount armature assembly 14 on magnetic member assembly 12. Torsion member 161 exerts a rotational or torsional moment on cantilever member 162 which in turn exerts a force in combination with the torsional moment against armature flange 140 to maintain armature flange 140 in engagement with the upper surfaces of the ends of magnetic core member legs 1241, 1242 extending outward from bobbin 125. With armature flange 140 in engagement with the upper surfaces of magnetic core member 124, armature 14 is rotated about the axis parallel to the upper edges of magnetic core member 124 thereby maintaining armature surface 143 in a spaced apart relationship with regard to pole areas 12410, 12420. In this, the release state, armature 14, via contact spring operate section 1313, FIG. 2, positions contact springs 1311 to disengage contacts 13110 from contacts 13210 and engage them with contacts 13010.

Electrical current applied to bobbin coil 120 enables magnetic core member 124 to generate magnetic flux at pole areas 12410, 12420 that operates, FIG. 5, to rotate armature assembly 14 about the axis parallel to the upper edges of the magnetic core member pole ends to engage armature surface 143 with pole areas 12410, 12420. Armature flange 140 is thus rotated such that L-shaped member 163 of spring member 16 moves upward thereby causing cantilever member 162 to increase the rotational moment of axial torsion member 161. In this position, armature 14 enables contact spring operate section 1313, FIG. 2, to position contact springs to disengage contacts 13110 from contacts 13010 and engage contacts 13110 with contacts 13210.

Upon removal of the electrical current from bobbin coil 120, torsion member 161 generates a torsional moment upon cantilever member 163, FIG. 4, which in turn exerts a force in combination with the torsional moment on armature flange 140 to rotate armature 141 to the normal release state.

Although the present embodiment of the invention discloses the use of an electrical current to enable magnetic core member 124 to generate magnetic flux to attract armature assembly 14, it is to be understood that the use of an electrical current to enable magnetic core member 124 to reduce generated magnetic flux to release armature assembly 14 is within the teaching of the invention. It is also to be understood that different configurations of contact assemblies with various combinations of contacts located thereon could be used as the instant contact assembly 13.

SUMMARY

It is obvious from the foregoing that facility, economy and efficiency of electromechanical relays may be substantially enhanced by a spring member configured for rotationally mounting an armature assembly on a magnetic member assembly to enable the magnetic member assembly to control a contact assembly to engage and disengage contacts located on the contact assembly. It is further obvious that a spring member for mounting an armature assembly on a magnetic member assembly and configured for generating a torsional moment in combination with a cantilever force on the armature assembly to maintain the armature assembly in a rotational relationship to control operation of a contact spring assembly substantially reduces the size of a relay structure and improves the operating sensitivity of the relay.

What is claimed is:

1. A relay (1) having an armature assembly (14) and a contact assembly (13) in combination with a magnetic member assembly (12) comprising means for mounting the armature assembly with respect to the magnetic member assembly to enable magnetic flux generated by pole areas of the magnetic member assembly to activate the armature assembly characterized in that said mounting means comprises spring means (16) for mounting the armature assembly to the magnetic member assembly with said spring means configured for generating a torsional moment in combination with a cantilever force on the armature assembly for maintaining the armature assembly in relationship with the magnetic member assembly to operate and release the contact assembly in response to the generated magnetic flux.

2. The relay set forth in claim 1
characterized in that
said spring means comprises
a generally L-shaped member (163) vertically positioned on an upper surface of the armature assembly and having one end (164) thereof formed for attachment thereto for holding the armature assembly.

3. The relay set forth in claim 2
characterized in that
said spring means comprises
a cantilever member (162) formed at a generally right angle from an end of said L-shaped member opposite said armature assembly attachment end for generating a force on the armature assembly normally maintaining the armature assembly rotated in a spaced apart relationship with respect to the magnetic member assembly.

4. The relay set forth in claim 3
characterized in that
said spring means comprises
a torsion member (161) formed at a generally right angle from an end of said cantilever member opposite said L-shaped member for connecting said spring member and attached armature assembly with said magnetic member assembly and for generating a torsional moment upon activation of said armature assembly to return said armature assembly to said spaced apart relationship upon removal of the magnetic flux generated by the magnetic member.

5. A relay (1) having an armature assembly (14) and a contact assembly (13) in combination with a magnetic member assembly (12) for activating said armature assembly to engage and disengage contacts located on the contact assembly comprising
means for mounting the armature assembly in relationship with respect to the magnetic member assembly to enable magnetic flux generated by pole areas of the magnetic member assembly to activate the armature assembly
characterized in that
said mounting means comprises
a spring member (16) for rotationally mounting the armature assembly on the magnetic member assembly with said spring member having one end (164) coupled to the armature assembly and extended into a generally L-shaped member (163) vertically positioned on an upper surface of the armature assembly with the upper end thereof formed at an angle into one end of a cantilever member (162) having the opposite end thereof pivotally formed into an axial torsion member (161) having the opposite end (160) connected to the magnetic member assembly for generating a torsional moment upon activation of the armature assembly to rotate the armature assembly to a normal release state upon removal of the magnetic flux at the magnetic member assembly pole areas.

6. An electromechanical relay (1) having an armature (141) with a flange member (140) attached to an upper surface thereof in combination with a contact assembly (13) and a U-shaped magnetic core member (124) with pole areas (12410, 12420)) at each end positioned in a coil wound bobbin (125) with the pole areas at each end extended outward from the bobbin for actuating the armature to control operation of the contact assembly comprising
spring means (16) for mounting the armature flange member on an upper surface of the magnetic core member thereby enabling rotational movement of the armature about an axis parallel to upper edges of the magnetic member pole areas in response to magnetic flux generated by the magnetic member pole areas to activate the armature
characterized in that
said spring mounting means comprises
a generally L-shaped member (163) vertically positioned in the center of an upper surface of the flange member and having one end (164) thereof formed for attachment to the flange member for holding the armature and flange member,
a cantilever member (162) formed at a generally right angle from an end of said L-shaped member opposite said flange member attachment end for generating a force on the flange member normally maintaining said armature rotated in a spaced apart relationship with respect to the magnetic member pole areas, and
a torsion member (161) formed at a generally right angle from an end of the said cantilever member opposite said L-shaped member for connecting said cantilever member and L-shaped member with attached armature to the coil winding bobbin and for generating a torsional moment upon activation of the armature by magnetic flux generated by the magnetic member pole areas functional to return the armature to said spaced apart relationship upon removal of the generated magnetic flux thereby enabling the contact assembly to close and open contacts positioned thereon.

* * * * *